US011025012B2

(12) United States Patent
Wang et al.

(10) Patent No.: US 11,025,012 B2
(45) Date of Patent: Jun. 1, 2021

(54) HIGH FREQUENCY ELECTRICAL CONNECTOR

(71) Applicants: FU DING PRECISION INDUSTRIAL (ZHENGZHOU) CO., LTD., Zhengzhou (CN); FOXCONN INTERCONNECT TECHNOLOGY LIMITED, Grand Cayman (KY)

(72) Inventors: Xiang-Dong Wang, Kunshan (CN); En-Jin Chang, Kunshan (CN); Dao-Zhen Bian, Kunshan (CN); Wei-Liang Zhang, Kunshan (CN); Jian-Long Hu, Kunshan (CN)

(73) Assignees: FU DING PRECISION INDUSTRIAL (ZHENGZHOU) CO., LTD., Zhengzhou (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/719,931

(22) Filed: Dec. 18, 2019

(65) Prior Publication Data

US 2020/0194939 A1 Jun. 18, 2020

(30) Foreign Application Priority Data

Dec. 18, 2018 (CN) ..... 201822131799.4

(51) Int. Cl.
*H01R 24/00* (2011.01)
*H01R 13/6581* (2011.01)
(Continued)

(52) U.S. Cl.
CPC ..... *H01R 13/6581* (2013.01); *H01R 13/2407* (2013.01); *H01R 13/6477* (2013.01)

(58) Field of Classification Search
CPC .. H01R 12/79; H01R 13/6471; H01R 12/716; H01R 12/724; H01R 12/737;
(Continued)

(56) References Cited

U.S. PATENT DOCUMENTS

2015/0056855 A1* 2/2015 Yu ..... H01R 13/6594 439/607.01
2015/0303610 A1* 10/2015 Hou ..... H01R 24/62 439/660

(Continued)

FOREIGN PATENT DOCUMENTS

CN 101364692 B 12/2010
CN 101364694 B 8/2011
CN 102904095 B 2/2015

*Primary Examiner* — Truc T Nguyen
(74) *Attorney, Agent, or Firm* — Ming Chieh Chang; Wei Te Chung

(57) ABSTRACT

An electrical connector with an insulative housing and a plurality of contacts retained thereto. The housing includes a base and a tongue extending forwardly from the base. Each first contact includes, along the front-to-back direction perpendicular to the transverse direction, a front first contacting section, exposed above a mating face of the tongue, a rear first soldering section extending out of the housing, and a first connecting section located therebetween wherein in the pair of first different contacts, the first connecting sections are transversely offset from the corresponding first contacting sections and toward each other so as to have therebetween a distance, in the transverse direction, smaller than that between the corresponding first contacting sections.

14 Claims, 10 Drawing Sheets

(51) Int. Cl.
*H01R 13/24* (2006.01)
*H01R 13/6477* (2011.01)

(58) Field of Classification Search
CPC ..... H01R 13/113; H01R 13/6205; H01R 13/6583; H01R 13/6585; H01R 13/6587; H01R 24/60; H01R 12/58; H01R 12/592; H01R 12/7023; H01R 12/71; H01R 12/712; H01R 12/721; H01R 12/73; H01R 13/04; H01R 13/512; H01R 13/514; H01R 13/6461; H01R 13/6466; H01R 13/6473; H01R 13/6581; H01R 13/6582; H01R 13/6593; H01R 13/6594; H01R 13/6599; H01R 13/6608; H01R 13/6658; H01R 13/7175; H01R 2107/00; H01R 24/20; H01R 24/28; H01R 31/005; H01R 43/205
See application file for complete search history.

(56) References Cited

U.S. PATENT DOCUMENTS

| | | | | |
|---|---|---|---|---|
| 2016/0181745 | A1* | 6/2016 | Hu | H01R 13/7031 439/676 |
| 2016/0294130 | A1* | 10/2016 | Guo | H01R 24/60 |
| 2016/0365655 | A1* | 12/2016 | Tsai | H01R 13/6461 |
| 2017/0373438 | A1* | 12/2017 | Qiu | H01R 13/5202 |
| 2018/0019531 | A1* | 1/2018 | Qiu | H01R 12/718 |
| 2018/0076581 | A1* | 3/2018 | Tsai | H01R 24/60 |
| 2018/0309241 | A1* | 10/2018 | Tsai | H01R 13/642 |

* cited by examiner

HIGH FREQUENCY ELECTRICAL CONNECTOR

BACKGROUND OF THE DISCLOSURE

1. Field of the Disclosure

The present disclosure relates to an electrical connector, and more particularly to an electrical connector for high frequency signal transmission.

2. Description of Related Arts

China Patent No. CN101364692 discloses a pair of signal contacts between a grounding contact and a power contact. Anyhow, some crosstalk may occur during signal transmission.

An improved arrangement is desired to have the electrical connector with the corresponding contacts properly arranged with each other in both the dimension and the configuration.

SUMMARY OF THE DISCLOSURE

An object of the invention is to provide an electrical connector with an insulative housing and a plurality of contacts retained thereto. The housing includes a base and a tongue extending forwardly from the base. The contacts includes first contacts composed of a pair of first differential contacts, a first power contact and a first grounding contact respectively located by two sides of the pair of first differential contacts in a transverse direction. Each first contact includes, along the front-to-back direction perpendicular to the transverse direction, a front first contacting section, exposed above a mating face of the tongue, a rear first soldering section extending out of the housing, and a first connecting section located therebetween wherein in the pair of first different contacts, the first connecting sections are transversely offset from the corresponding first contacting sections and toward each other so as to have therebetween a distance, in the transverse direction, smaller than that between the corresponding first contacting sections.

The contacts further include second contacts composed of a second grounding contact with two pairs of second differential contacts by two sides in the transverse direction, respectively. Each second contact includes, along the font-to-back direction, a front second contacting section exposed upon the mating face of the tongue, a rear second soldering section extending out of the housing, and a second connecting section therebetween. Similar to the pair of first different contacts, in each pair of second differential contacts the second connecting sections are transversely offset from the corresponding second contacting sections and toward each other so as to have therebetween a distance, along the transverse direction, smaller than that between the corresponding second contacting sections.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
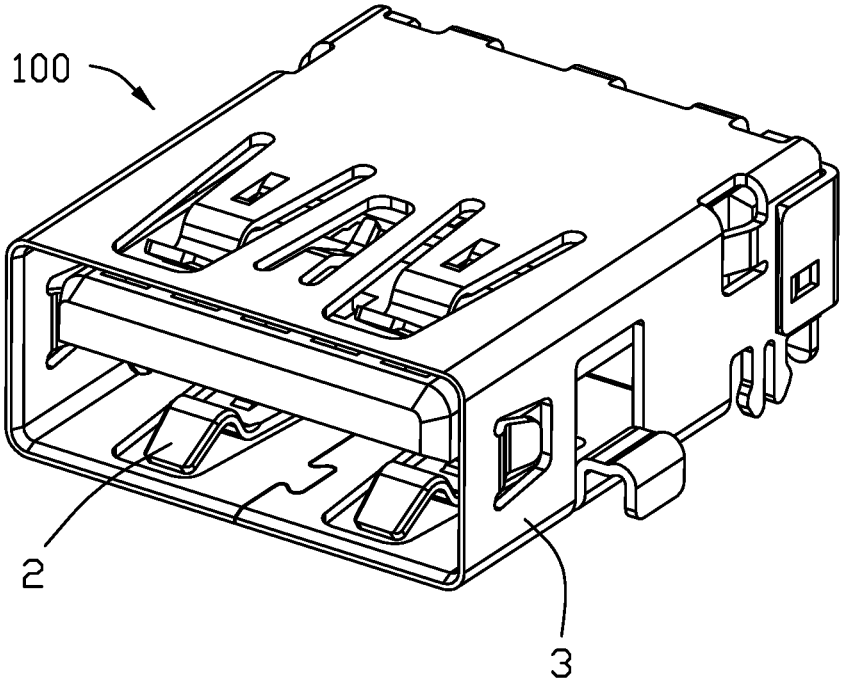
FIG. 1 is a perspective view of an electrical connector according to the invention.
Figure 2:
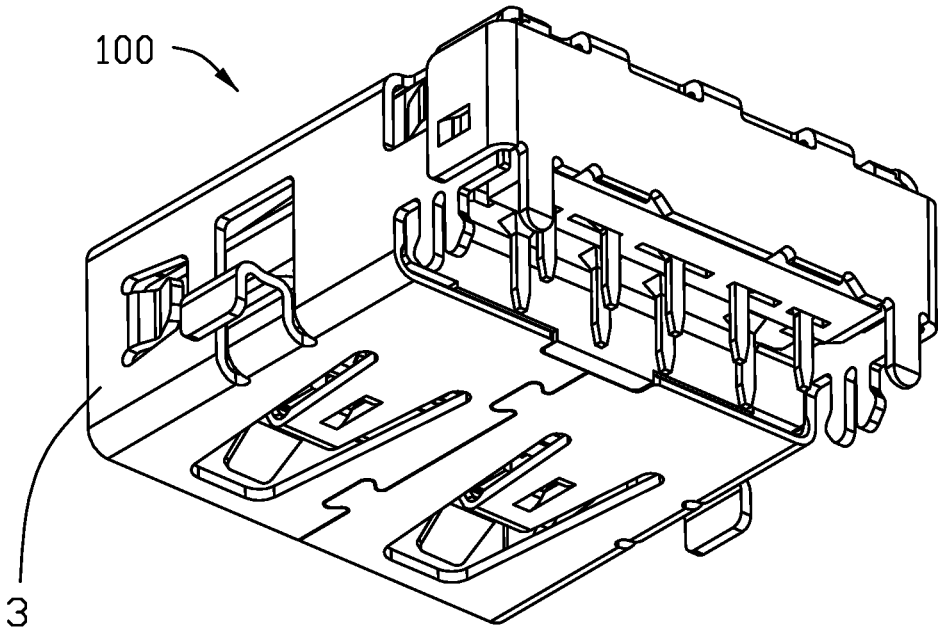
FIG. 2 is another perspective view of the electrical connector of FIG. 1.
Figure 3:
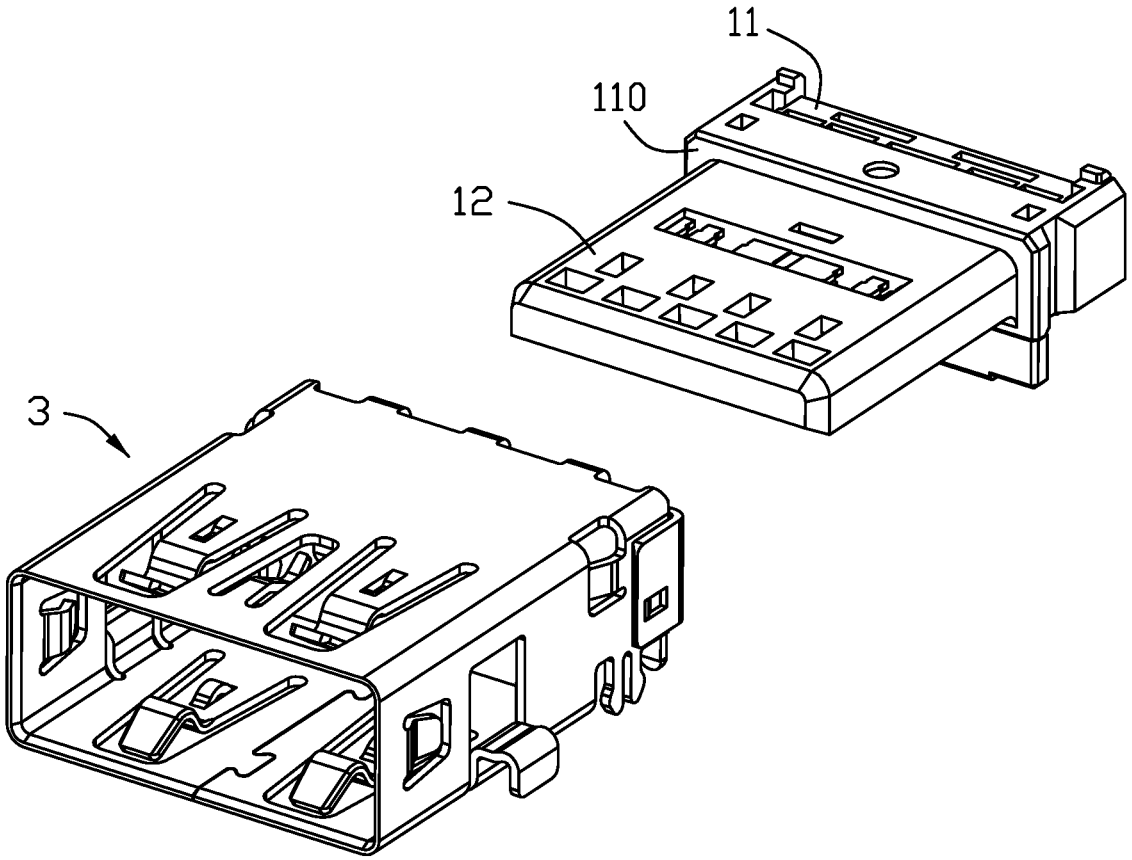
FIG. 3 is an exploded perspective view of the electrical connector of FIG. 1.
Figure 4:
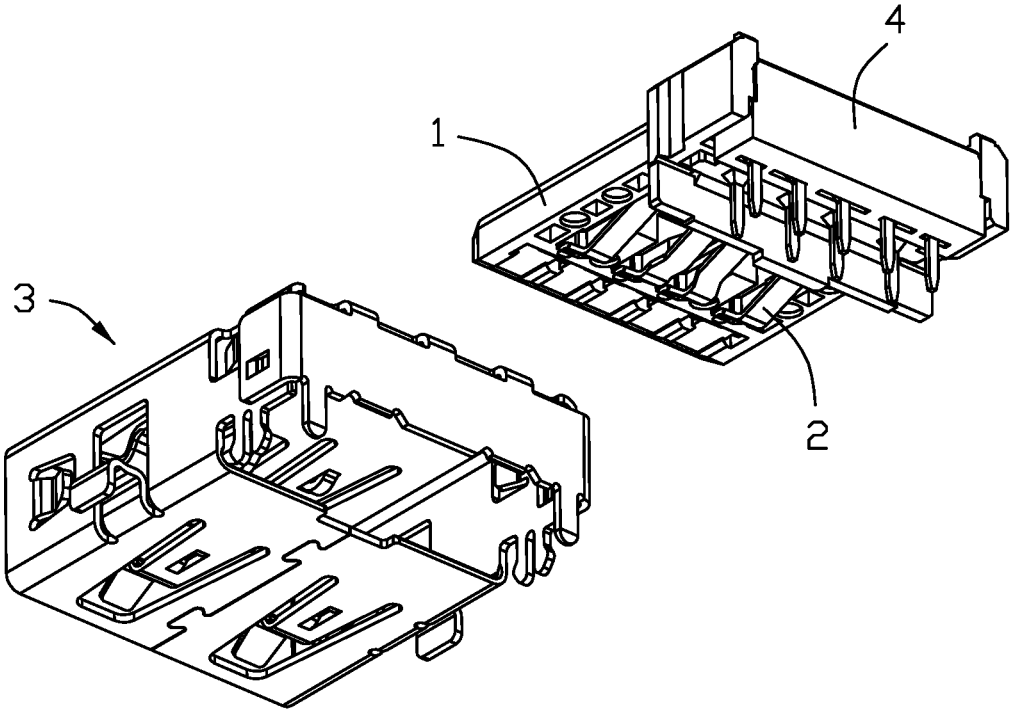
FIG. 4 is another exploded perspective view of the electrical connector of FIG. 3.
Figure 5:
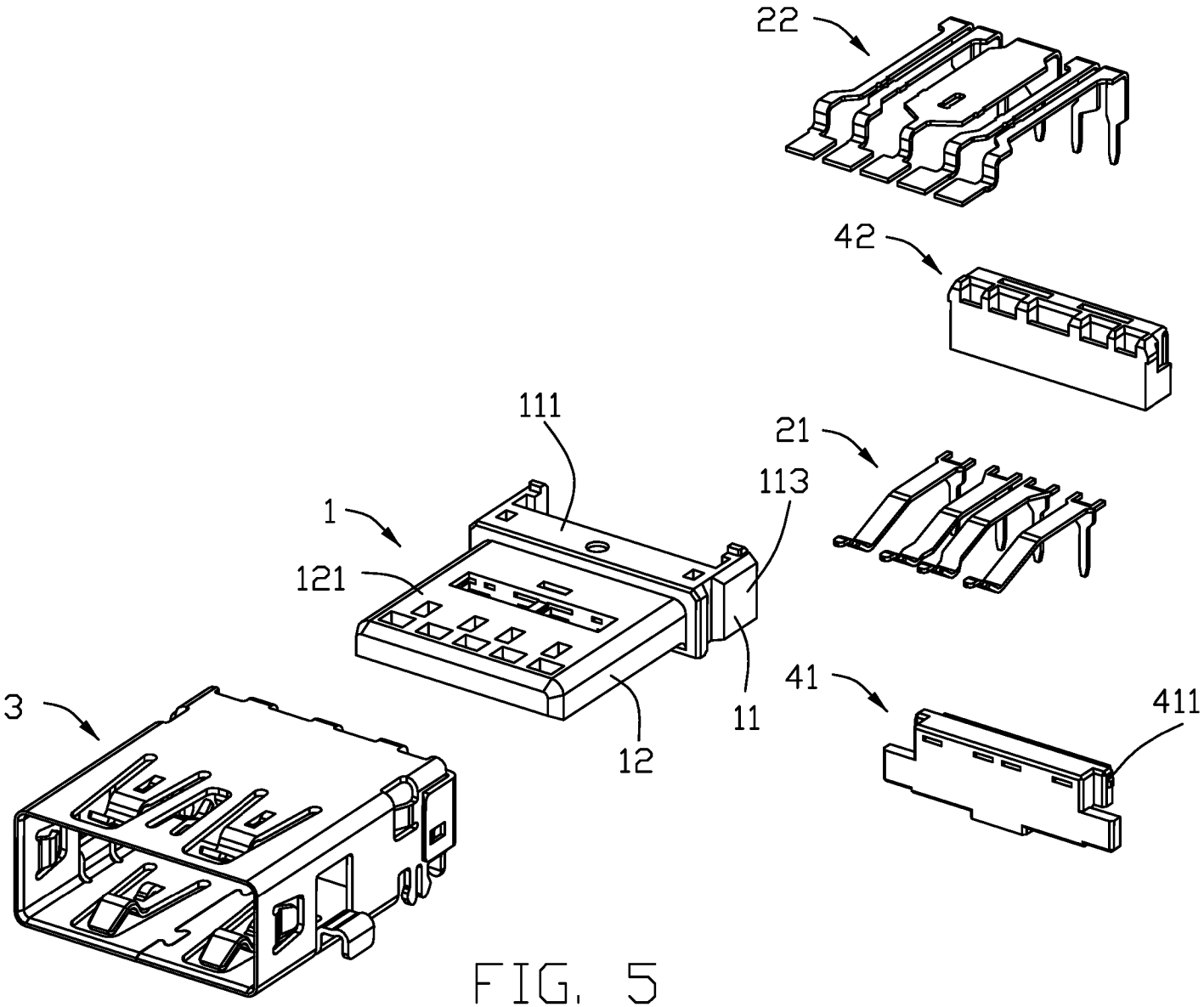
FIG. 5 is a further exploded perspective view of the electrical connector of FIG. 3.
Figure 6:
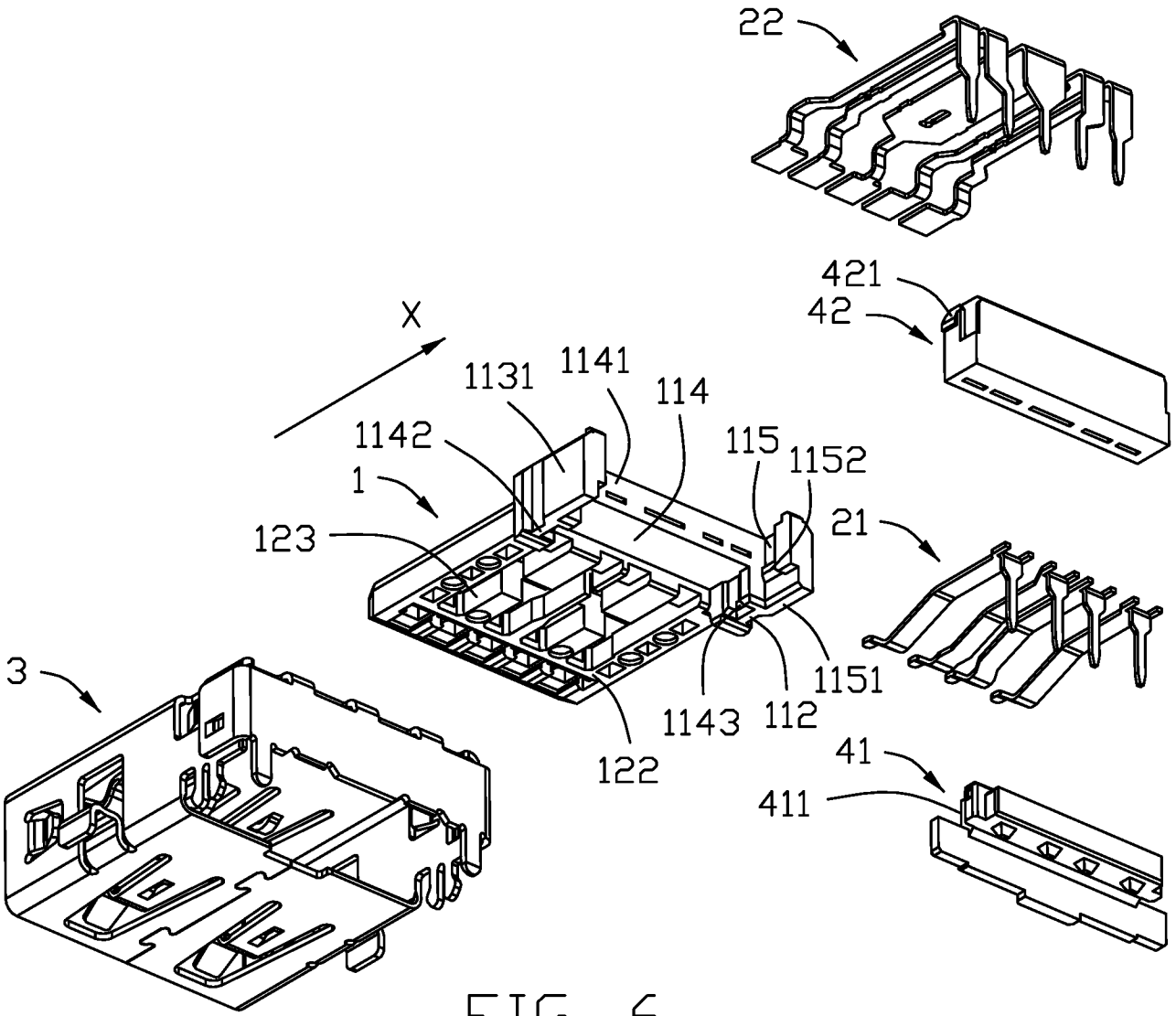
FIG. 6 is another exploded perspective view of the electrical connector of FIG. 1.
Figure 7:
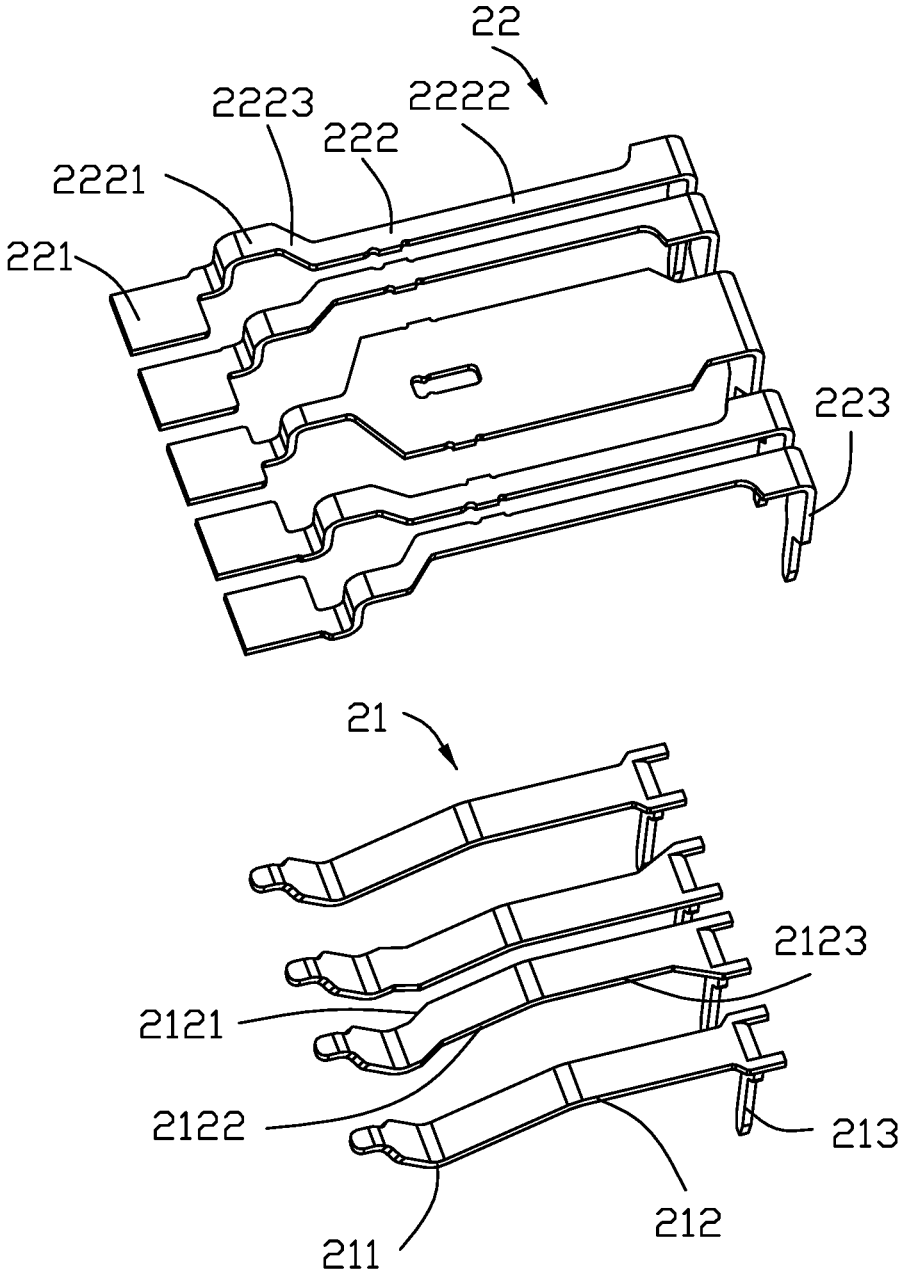
FIG. 7 is a perspective view of the contacts of the electrical connector of FIG. 1.
Figure 8:
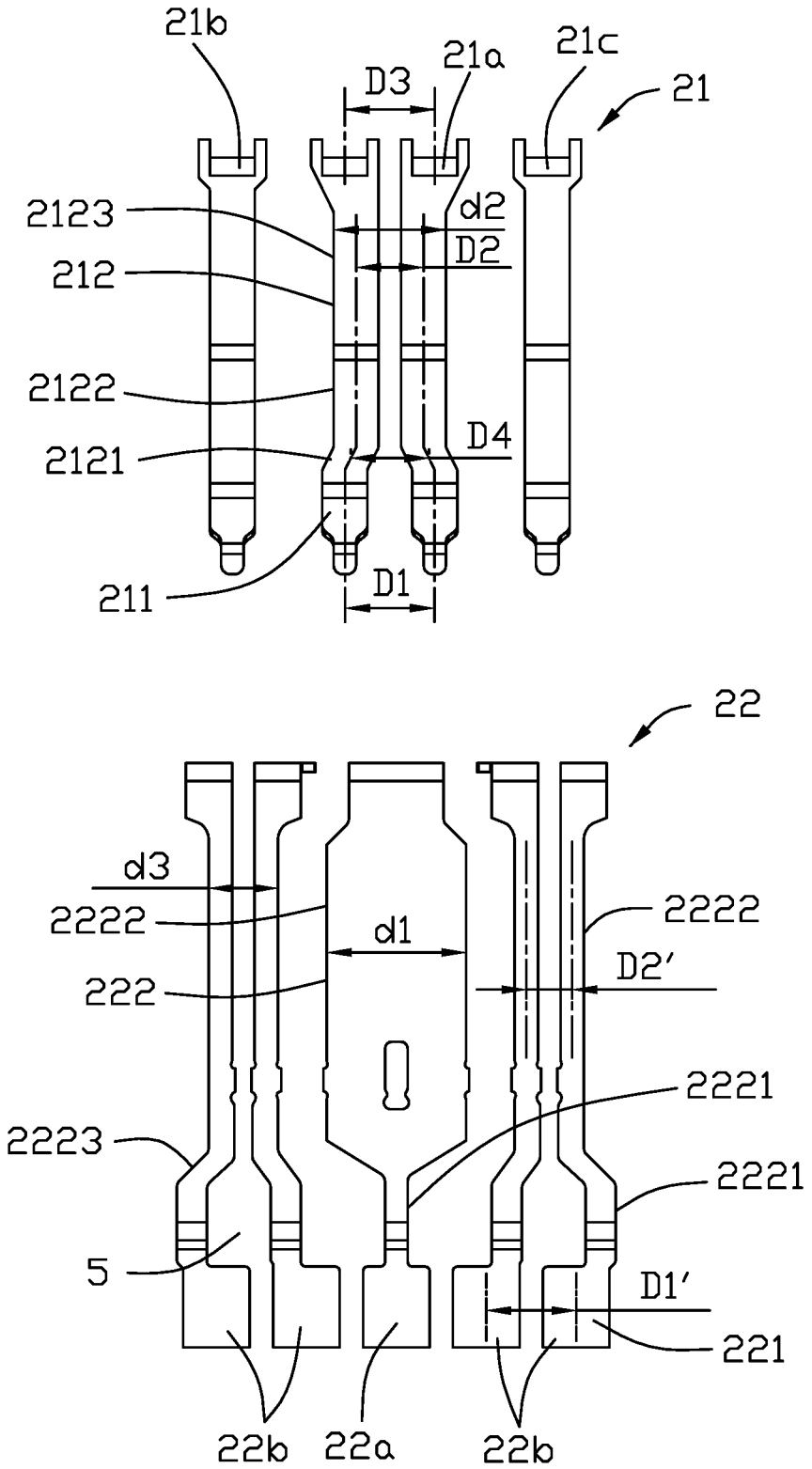
FIG. 8 is a top view of the contacts of the electrical connector of FIG. 1.
Figure 9:
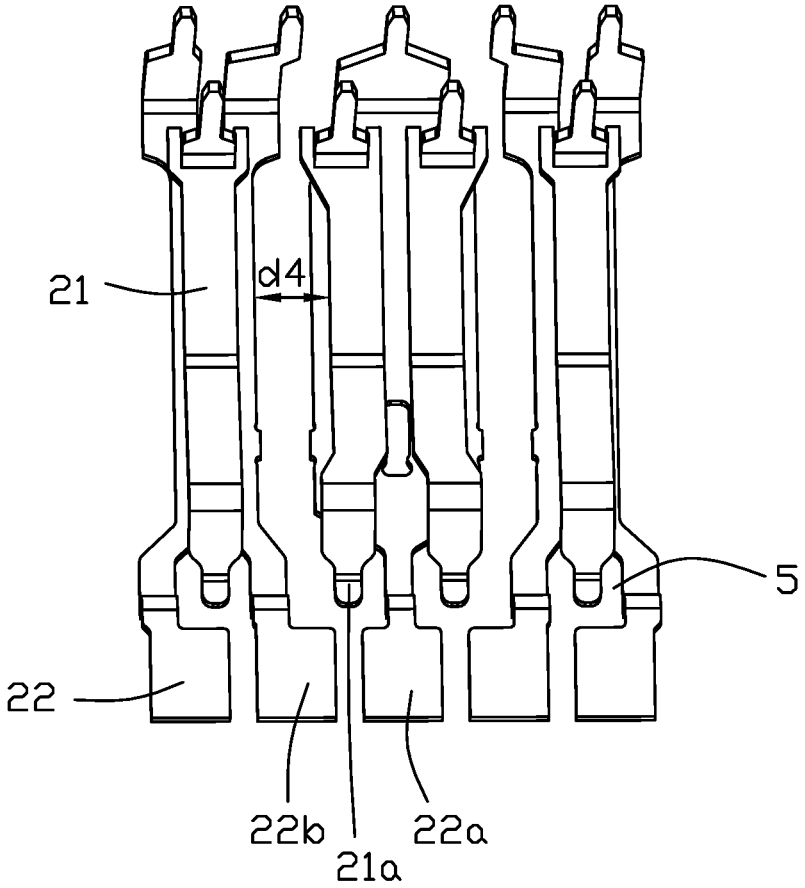
FIG. 9 is a perspective view of the arranged contacts of the electrical connector of FIG. 1.
Figure 10:
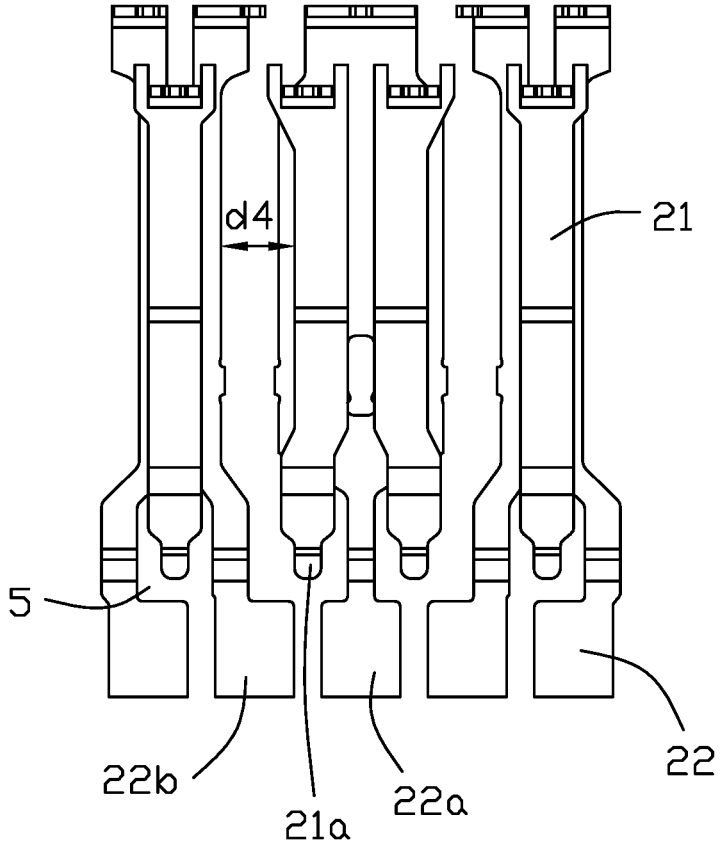
FIG. 10 is a bottom view of the arranged contacts of the electrical connector of FIG. 9.

Referring to FIGS. 1-10, an electrical connector 100 includes an insulative housing 1, a plurality of contacts 2 retained in the housing 1, a metallic shell enclosing the housing 1, and a positioning seat 4.

The housing 1 includes a base 11, and a tongue 12 forwardly extending from the base 11. The base 11 includes opposite upper surface 111 and lower surface 112 and two side surfaces 113. In the base 11, the first fixing slot 114 is recessed from the lower surface 112, and a second fixing slot 115 extends vertically. Each side surface 113 forms a protrusion 1131 to engage the shell 3.

The first fixing slot 114 includes a first bottom wall 1141 and two first side walls 1142 to form two engaging slots 1143. The two fixing slots 115 form, along the corresponding side walls 1142, two second side walls 1151 with corresponding engaging parts 1152. The engaging slots 1143 and the engaging parts 1152 are respectively engaged with the positioning seat 4. The tongue includes an upper face 121, a lower face 122 opposite to the top face 121, and a plurality of passageways 123 formed in the lower face 122.

The contacts 2 include a plurality of first contacts 21 retained in the corresponding passageways 123, and a plurality of second contacts insert-molded within the housing 1. The first contacts 21 include a pair of first differential contacts 21*a*, and a first grounding contact 21*b* and a first power contact 21*c* respectively located by two sides of the pair of first differential contacts 21*a*. Each first contact 21 includes a first contacting section 211 extending beyond the mating face, i.e., the lower face 122, a first soldering section 213 extending out of the housing 1, and a first connecting 212 linked between the first contacting section 211 and the first soldering section 213. The distance between the first connecting section 212 of the pair of first differential contacts is smaller than that between the corresponding contacting sections. Understandably, such a distance refers to the pitch measured by two center lines thereof. The first connecting section 212 includes a first offsetting section 2121 linked with the corresponding first contacting section 211, a first oblique section 2122 linked to the first offsetting section 2121, and a first horizontal section 2123 linked between the first oblique section 2122 and the first soldering section 213. The distance between the two first oblique sections 2122 is equal to the distance between two first horizontal section 2123. The distance D2 between the two first horizontal sections 2123 is 1.5 mm which is smaller than the distance D1 between the two first contacting sections 211 while the distance D1 is equal to the distance D3 between the two first soldering sections 213. Notably, the difference between the distance D1 and the distance D2 results from the first offsetting sections 2121. In fact, the distance D2 is decreases from 2.0 mm of the conventional design to 1.5 mm of the instant invention. Notably, both the first connecting section 211, the first offsetting section 2121 and the first oblique section 2122 are deflectable in the vertical direction so as to be deemed as a spring contacting arm with the corresponding first connecting section 211 at the free end. Actually, both the first offsetting section 2121 and the corresponding first oblique section 2122 extend in an oblique direction while the first contacting section 211 extends in an opposite oblique direction so as to form a contacting point/apex therebetween. The distance D4 between the first offsetting sections 2121 of the pair of first differential contacts 21*a* is variant between the distance D2 and the distance D1/D3.

The second contacts 22 include a second grounding contact 22*a* and two pairs of second differential contacts 22*b* respectively located by two sides of the second grounding contact 22*a*. Each second contact 22 includes a second contacting section 221 exposed upon the mating face, i.e., the lower face 122, a second soldering section 223 extending out of the housing 1, and a second connecting section 222 linked between the second contacting section 221 and the second soldering section 223. In each pair of second differential contacts 22*b*, the corresponding second connecting sections 222 are offset from the corresponding second contacting section 221 and toward each other.

In the second contact 22, the second connecting section 222 includes a reduced section 2221, and a second horizontal section 2222 located between the reduced section 2221 and the second soldering section 223. The width d1 of the second horizontal section 2222 of the second grounding contact 22*a* is larger than the distance d2 measured by two outermost edges of the corresponding first horizontal sections 2123 of the pair of first differential contacts 21*a*. In fact, the width d1 of the second horizontal section 2222 of the second grounding contact 22*a* is increased from the original 2.1 mm of the conventional design to 3.1 mm of the instant invention.

in each pair of second differential contacts 22*b*, a second offsetting section 2223 is formed between the corresponding reduced section 2221 and the corresponding second horizontal section 2222. Notably, the distance between the two second horizontal sections 2222 is smaller than that between the corresponding second contacting sections 221. In this embodiment, the distance d3 measured by two opposite outermost edges of the second horizontal sections 2222 of the pair of second differential contacts 22*b* is larger than the width of either the first grounding contact 21*b* or the first power contact 21*c*.

The first connecting sections 212 of the first contacts 21 and the second connecting sections of the second contacts 22 are arranged in two rows in the vertical direction. In a top view, the pair of first differential contacts 21*a* is located between two pairs of second differential contacts 22*b*. A space 5 is formed between the reduced sections 2221 of the pair of second differential contacts 22*b* to receive the first contacting section 211 of the corresponding first power contact 21*b* or the first grounding contact 21*c*.

The positioning seat 4 includes a first seat 41 secured to the first fixing slot 114, and the second seat 42 secured to the second fixing slot 115. The first positioning seat 41 includes the securing parts 411 engaged with the corresponding engaging slots 1143 for securing the first seat 41 thereto. The second positioning seat 42 includes the securing parts 421 engaged with the engaging parts 1152 for securing the second seat 42 thereto.

In the invention, on one hand, the distance D2, i.e., the pitch, between the first horizontal sections 2123 of the pair of first differential contacts 21*a* is reduced from 2.0 mm to 1.5 mm so as to reduce the corresponding distance d2 measured by two outermost edges thereof. On the other hand, the width d1 of the second horizontal section 2222 of the second grounding contact 22*a* is increased from 2.1 mm to 3.1 mm so as to be larger than the distance d1. This arrangement may provide more efficient shielding. In addition, the second horizontal sections 2222 of the pair of second differential contacts 22*b* are also offset toward each other by reducing the pitch D2' between the second horizontal sections 2222 of the pair of second differential contacts 22*b* compared with the pitch D1' between the second contacting sections 221 so as to increase the distance d4 (FIGS. 9 and 10), measured by two corresponding opposite inner edges between the first horizontal section 2123 of the pair of first differential contact 21*a* and the second horizontal section 2222 of the pair of neighboring second differential contacts 22*b*, from 1.43840 mm to 1.64210 mm, thus eliminating the crosstalk due to signal transmission.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing including a base and a tongue extend forwardly from the base in a front-to-back direction, the tongue forming a mating face;

a plurality of first contacts retained to the housing in one row along a transverse direction perpendicular to the front-to-back direction, each of said fist contacts including, along the front-to-back direction, a first contacting section, a first soldering section and a first connecting section therebetween;

a plurality of second contacts retained to the housing in another row along the transverse direction, each of the second contacts including, along the front-to-back direction, a second contacting section, a second soldering section and a second connecting section therebetween;

the first connecting sections being spaced from the second connecting sections in a vertical direction perpendicular to both the front-to-back direction and the transverse direction while the first contacting sections and the second contacting sections being commonly exposed upon the mating face;

the first contacts including a pair of first differential contacts and a first power contact and a first grounding contact located by two sides of the pair of first different contacts in the transverse direction; and the second contacts including a second grounding contact and two pairs of second differential contacts located by two sides of the second grounding contact in the transverse direction; wherein in the pair of first differential contacts, a pitch (D1) defined between the first contacting sections is larger than a pitch (D2) defined between the first connecting sections, and in the pair of second differential contacts, a pitch (D1') defined between the second contacting sections is larger than a pitch (D2') defined between the second connecting sections so as to increase a distance (d4) between the pair of first differential contacts and the pair of second differential contacts in the transverse direction in a top view along the vertical direction.

2. The electrical connector as claimed in claim 1, wherein said distance (d4) is 1.64 mm.

3. The electrical connector as claimed in claim 1, wherein in the pair of first differential contacts, the first connecting section includes a first offsetting section linked to the corresponding first contacting section so as to result in a pitch change between the first contacting sections and the first connecting sections, and in the pair of second differential contacts, the second connecting section includes a second offsetting section closer to the corresponding second contacting section as to result in another pitch change between the second contacting sections and the second connecting sections.

4. The electrical connector as claimed in claim 3, wherein in the pair of first differential contacts, the first offsetting sections of the first connecting sections extend toward each other in the transverse direction so as to reduce the corresponding pitch (D2); in the pair of second differential contacts, the second offsetting sections of the second connecting sections extend toward each other in the transverse direction so as to reduce the corresponding pitch (D2').

5. The electrical connector as claimed in claim 4, wherein the first connecting section further includes an oblique section linked to the corresponding first offsetting section, and a first horizontal section linked between the first oblique section and the first soldering section.

6. The electrical connector as claimed in claim 3, wherein the pitch (D2) of the pair of first differential contacts is 1.5 mm.

7. The electrical connector as claimed in claim 3, wherein the second connecting section further includes a reduced section linked between the second contacting section and the second offsetting section.

8. The electrical connector as claimed in claim 7, wherein a space (5) is formed between the two reduced sections of the pair of second differential contacts to receive the first contacting section of the corresponding first power contact or the first grounding contact.

9. The electrical connector as claimed in claim 1, wherein the second connecting section of the second grounding contact defines a width (d1) which is larger than a distance (d2) defined between two opposite outermost edges of the first connecting sections of the pair of first differential contacts so as to full cover the pair of first differential contacts in the vertical direction.

10. The electrical connector as claimed in claim 9, wherein the width (d1) of the second connection section of the second grounding contact is 3.1 mm.

11. The electrical connector as claimed in claim 1, wherein the pitch (D1) of the first contacting sections of the pair of first differential contacts is same with another pitch (D3) of the first soldering sections.

12. The electrical connector as claimed in claim 1, further including a first seat to position the first soldering sections, and a second seat to position the second soldering sections, wherein the housing includes an engaging slot to secure the first seat, and an engaging part to secure the second seat.

13. The electrical connector as claimed in claim 12, wherein at least one of the first seat and the second seat is configured to be assembled to the housing upwardly in the vertical direction.

14. The electrical connector as claimed in claim 1, wherein the first connecting sections are positioned below the second connecting sections in the vertical direction.

* * * * *